United States Patent [19]

Laesser et al.

[11] 4,109,457

[45] Aug. 29, 1978

[54] UNIVERSAL ELECTRONIC TIMEPIECE

[75] Inventors: Claude Laesser, La Chaux-de-Fonds; Hubert Portmann, Colombier, both of Switzerland

[73] Assignee: Ebauches S.A., Switzerland

[21] Appl. No.: 740,036

[22] Filed: Nov. 8, 1976

[30] Foreign Application Priority Data

Nov. 19, 1975 [CH] Switzerland ..... 15084/75

[51] Int. Cl.[2] ..... G04B 19/22

[52] U.S. Cl. ..... 58/43; 58/5; 58/42.5

[58] Field of Search ..... 58/4 R, 5, 42.5, 43, 58/44

[56] References Cited

U.S. PATENT DOCUMENTS

| | | | |
|---|---|---|---|
| 3,486,322 | 12/1969 | Abend | 58/43 |
| 3,940,920 | 3/1976 | Nakamura | 58/42.5 |
| 4,044,545 | 8/1977 | Shimizu | 58/42.5 |

*Primary Examiner*—Robert K. Schaefer
*Assistant Examiner*—Leonard W. Pojunas, Jr.
*Attorney, Agent, or Firm*—Silverman, Cass & Singer, Ltd.

[57] ABSTRACT

A universal electronic timepiece including a movable indicator for the twenty-four time-belts of the earth. A moving element includes control contacts which are movable into engagement with a plurality or bed of electric contacts in synchronism with the movable indicator of the time-belts. The contacts and the control members are spaced radially from one another and the control members are also spaced circumferentially from one another. The timepiece includes a display device which receives information which is a function of the time and of the condition of the control members and contacts such that it may display at least at request the time of the time-belt selected by the movable indicator of the time-belts.

4 Claims, 14 Drawing Figures

FIG. 6
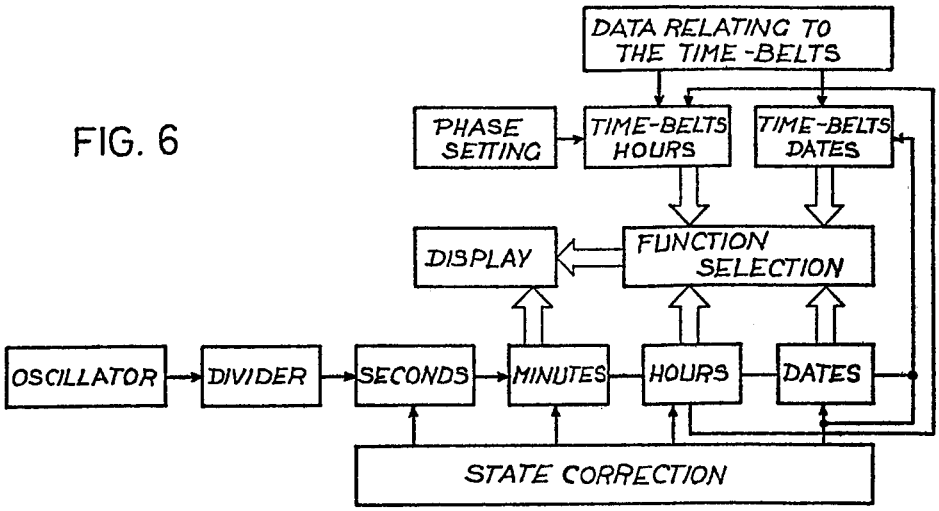
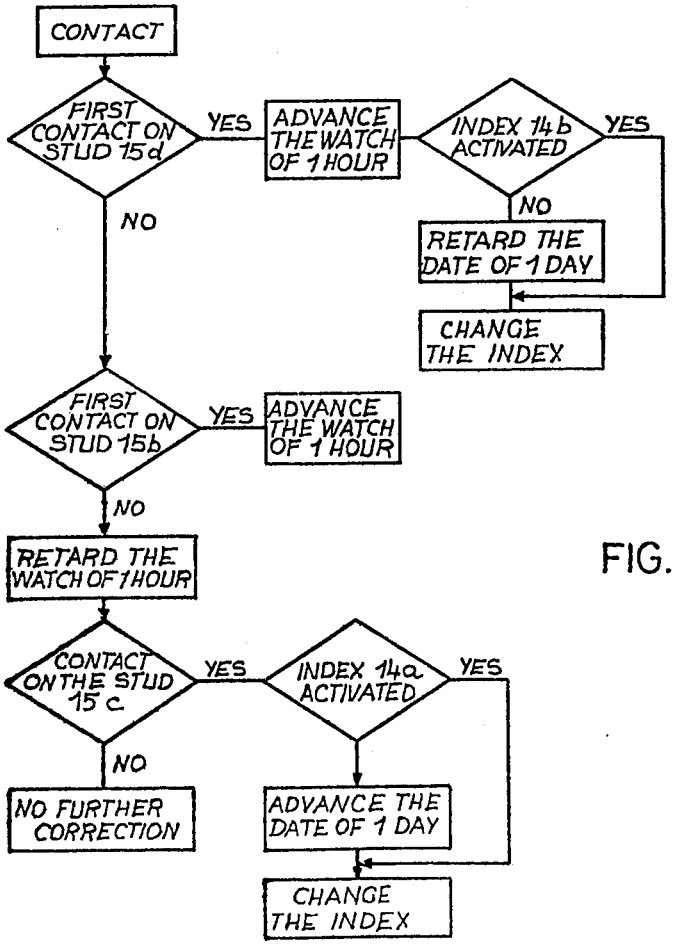
FIG. 7

UNIVERSAL ELECTRONIC TIMEPIECE

The present invention relates to a universal electronic timepiece.

This timepiece is characterized by the fact that it comprises a movable indicator of the time-belts, the displacements of which are controlled manually, at least a bed of electric contacts, control members of the said contacts, carried by a movable element moving in synchronism with the said indicator of the time-belts, the relative position of these contacts and of the said control members being such that the contacts are closed in a different order according the sense in which is moved the said indicator, the timepiece comprising moreover a display device arranged in such a way as to receive information which is function on the one hand from the condition of a basis of time and on the other hand from the condition of the said contacts, so that it displays, at least at request, the time of the time-belt selected by the said indicator of the time-belts.

The drawing shows, by way of example, one embodiment of the object of the invention.

FIG. 6 is a block diagram of the several elements of the watch.

FIG. 7 is a table of the logic functions of the watch.

The watch represented comprises a display device arranged in such a way as to display the hours at 1, the minutes at 2, and the dates at 3. The display device indicates also, at 4, if it is the time ante-morning or post-morning which is displayed, this indication being more particularly useful in the case when the hours can be displayed only up to 12 and not up to 24.

Figure 5:
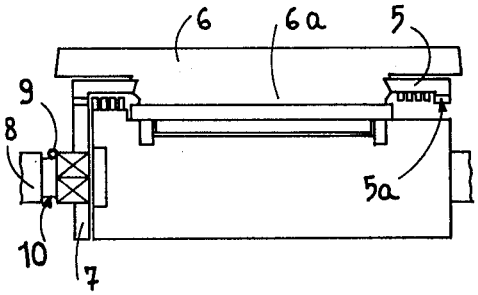
FIG. 5 is an elevational view thereof.

The watch represented comprises a crown 5 which is rotatably mounted on a central protrusion 6*a* (FIG. 5) of the glass which is designated by 6. This crown 5 is provided with an edge toothing 5*a* (FIG. 5) with which cooperates a wheel 7 mounted on a portion of square cross-section of the control stem 8, which is axially movable and which is maintained by a wire spring 9 engaged in a groove 10 provided in the said stem. While rotating manually the stem 8, by means of a control crown 11 (FIG. 1), one rotates the crown 5.

Figure 1:
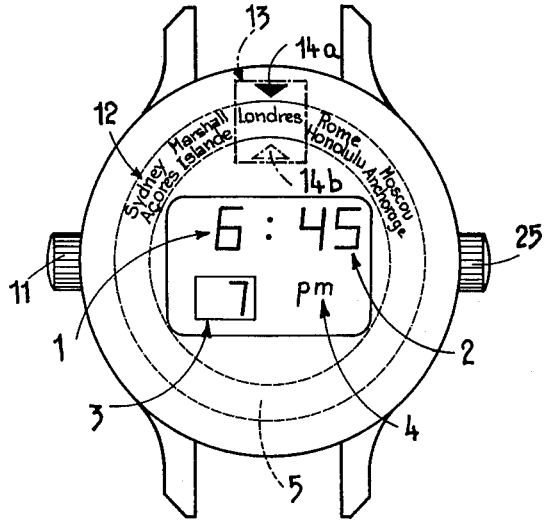
FIG. 1 is a plane view of a universal electronic wristwatch.

This crown is divided in twelve sectors carrying each two indications 12 of places (cities or countries) appearing in a window 13 represented in dot-and-dash lines in FIG. 1. The two indications of each sector are situated the one in the vicinity of the outer periphery of the crown 5 and the other one in the vicinity of its inner periphery. The two indications of each group correspond to places situated at the antipodes one from another, the indication "LONDRES", however, having no pendant since the antipode of this city is a point of the Pacific Ocean situated on high seas. Thus, these 12 divisions of the crown 5, with their two indications each, indicate the twenty-four time-belts of the earth.

The watch comprises two electro-optic indexes 14*a* and 14*b* which are alternatively activated and which indicate if one has to consider the outer or the inner indications of the crown 5.

The watch represented comprises a bed of four contact blades 15*a*, 15*b*, 15*c* and 15*d*, cut in a small plate 15 secured to the frame by a screw 16 and the ends of which are situated opposite four contact studs 17, 18, 19 and 20, respectively, the switches thus constituted closing themselves during the rotation of the crown 5 owing to protrusions 5*a* of this crown which are situated on the face thereof opposite to this one carrying the indications 12 of the names of places. It is to be noted that these switches could be replaced by Reed relays and the protrusions 5*b* by magnets operating these relays.

These protrusions 5*b* are distributed in groups, each of two protrusions, the number of which corresponds to the number of the divisions of the crown 5, that is to say twelve, and which are equally angularly distributed under the crown. The two protrusions 5*b* of each group are situated at different distances from the center of the crown 5 and are shifted angularly one with respect to the other. Hence, at the passage of each group of protrusions 5*b* of the crown 5 opposite the bed of the blades 15*a* to 15*d*, two of these blades, i.e. blades 15*a* and 15*b*, are operated so as to come in contact with the studs 17 and 18, respectively, the closing of these contacts being effected in a different order the crown 5 rotates in one sense or in the other, due to the angular shifting of the protrusions 5*b* of each group.

The closing of these switches or contacts and the order in which it is effected produces the going forward or the going slow of the hour contained in the hours counter of the time-belts, by reason of one hour for each group of protrusions 5*b*.

Figure 4:
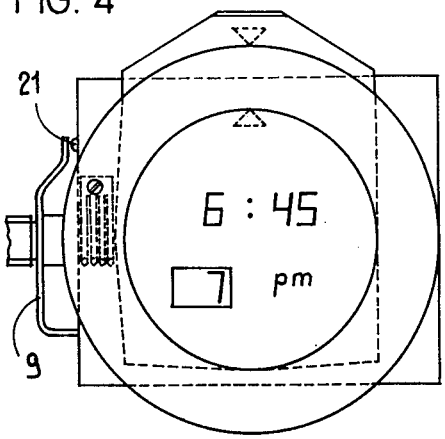
FIG. 4 is a plane view of a portion of this watch.

It is to be noted that the watch is arranged in such a way that the display device displays at 1 permanently the hour of a determined place, which will be the local time, and that it does display the hour of the place selected by the crown 5, that is to say the place appearing in the window 13 on the side where is situated this one of the two indexes 14*a* and 14*b* which is activated, only at request, this request having also for effect to make visible the activation of one of the indexes. The request is obtained by exerting a pressure on the crown 11, that urges the wire 9 to come into contact with a stud 21 (FIG. 4). As soon as the pressure on the crown 11 is released, or with a delay of some seconds, the watch resumes the display of the local time. In the case the crown 5 would be accessible from the outside of the watch, that would permit to rotate it while acting directly thereon, the crown could be movable axially so that while exerting a pressure thereon one obtains the display of the selected hour.

As a modification, one could have the case where the watch displays permanently the hour of the place selected by the crown 5 or also the case where, at each movement imparted to the crown 5, the display passes from the local time to the time of the place selected by the crown, this last display being maintained during some seconds after which the display of the local time is resumed from itself.

It is to be noted that the group of the protrusions 5*b* of the crown 5 situated between the time-belt of Iceland and Marshall Island and this one of London and of its antipode, not designated, comprises four protrusions instead of two, the two supplementary protrusions being situated at different distances from the center of the crown as well as at different distances from the distances from the center of the two other protrusions and being angularly shifted one with respect to the other as well as with respect to the two other ones. These two supplementary protrusions are intended to act, when their group is opposite the bed of the contact blades, on the two blades 15*c* and 15*d* of this bed, that permutes the activation of the indexes 14*a* and 14*b*. For the clearness of the drawing, the bed of the contact blades has been represented at the left side of FIG. 1 but it is actually located at the upper part of this latter.

Figure 8:
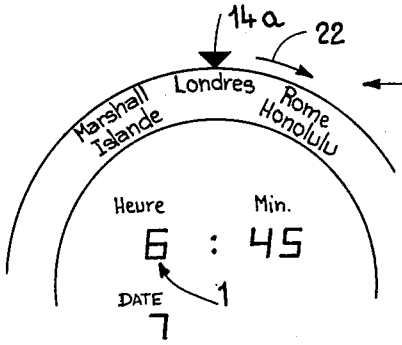
FIGS. 8 to 13 are plane views of a portion of a watch, in several operating positions.
Figure 9:
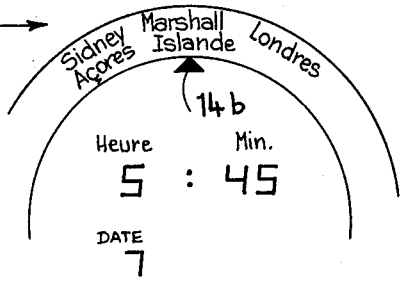

FIGS. 8 to 13 illustrate several operations of the watch as disclosed and represented:

If, for instance, from the position represented in FIG. 8, in which the outer index 14*a* is activated and in which it is the time-belt of London which is opposite the said index, so that it is the time of this time-belt which is then displayed at request, one rotates the crown 5 in the sense indicated by the arrow 22, one produces the permutation of the activation of the indexes, and the going slow of one hour of the time displayed at request, the date having not changed.

If one considers the table of the logic functions of FIG. 7, one ascertains that the following functions are operated:

Contact blade 15*d*? No.

Contact blade 15*b*? No: The watch is slow of one hour.

Contact blade 15*c*? Yes.

Is index 14*a* activated? Yes : The activation of the indexes changes and one passes from index 14*a* to index 14*b*, so as to really pass from London to Iceland, that is to say from the outer zone of crown 5 to the inner zone.

The date is not changed.

Figure 10:
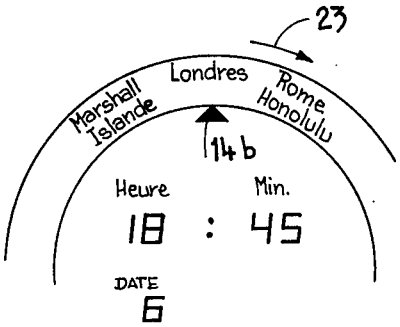
Figure 11:
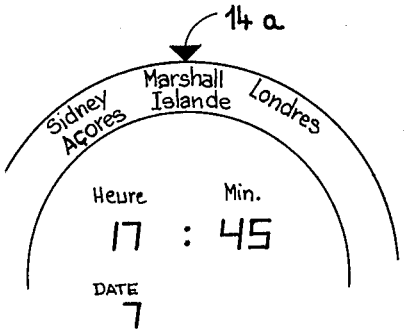

In the example of FIGS. 10 and 11, one passes from the position in which is displayed at 1, at request, the time of the time-belt situated at the antipodes of London to this one where is displayed, also at request, the time of the Marshall Islands. To this effect, one rotates the crown 5 in the clockwise direction, according to the direction of the arrow 23, that permutes the activation of the indexes, passing from 14*b* to 14*a*, that bring the hour to go slow of one unit and that brings the date to go forwards of one unit too.

If one considers the table of the logic functions of FIG. 7, one ascertains that one has followed the following way:

Contact blade 15*d*? No.

Contact blade 15*b*? No: The watch is slow of one hour.

Contact blade 15*c*? Yes.

Is index 14*a* activated? No: The date is going forwards of one day (as a matter of fact, one has passed the line of change of date which is situated between the antipode of London and Marshall Islands) and the activation of the indexes changes.

Figure 12:
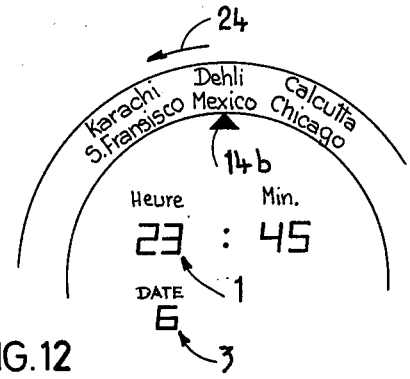
Figure 13:
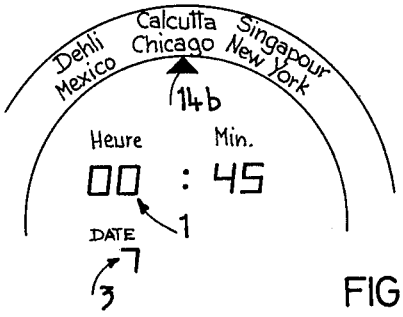

In the example of FIGS. 12 and 13, if, passing from the position of FIG. 12, where the hour of Mexico is displayed at request, one rotates the crown 5 in the counter-clockwise direction, indicated by the arrow 24, the hour goes forwards of one unit, as well as the date, the new indication corresponding to Chicago.

The table of the logic functions of FIG. 7 gives the following indications:

| | |
|---|---|
| Contact blade 15d? No<br>Contact blade 15b? Yes | The watch is going forwards of one hour |

The change of date is not due to a correction but to the ordinary functions of the watch which have for effect that the date changes always when one passes over midnight, that is to say from 23.59 o'clock to 0.01 o'clock.

It is to be noted that the watch as disclosed and represented has to comprise a switch permitting to modify the condition of the hours counter and of the dates counter of the time-belt so as to permit the putting in phase of the hour of the time of the time-belt and of the local time. It is however not necessary this switch be accessible from the outside of the watch since a shifting between the time-belt and the local time cannot occur during a stop of the watch, for instance at the opportunity of a change of the source of current, following which the setting by means of the ordinary setting crown, designated by 25 (FIG. 1), will act only on the local time and not on the information relating to the time-belt. It is to be noted that, during the correction of the condition of the watch by means of the crown 25, one can act on the seconds, the minutes, the hours and the dates, the correction acting also on the date of the time-belt.

Figure 2:
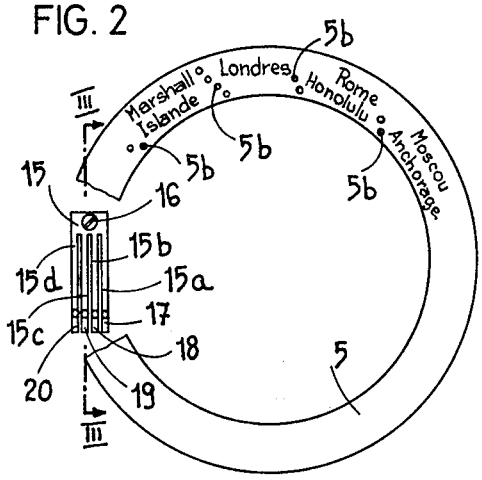
FIG. 2 is a plane view of a detail with a pulled out portion.
Figure 3:
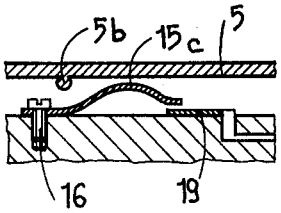
FIG. 3 is a sectional view of a detail, along line III—III of FIG. 2, at a larger scale.
Figure 14:
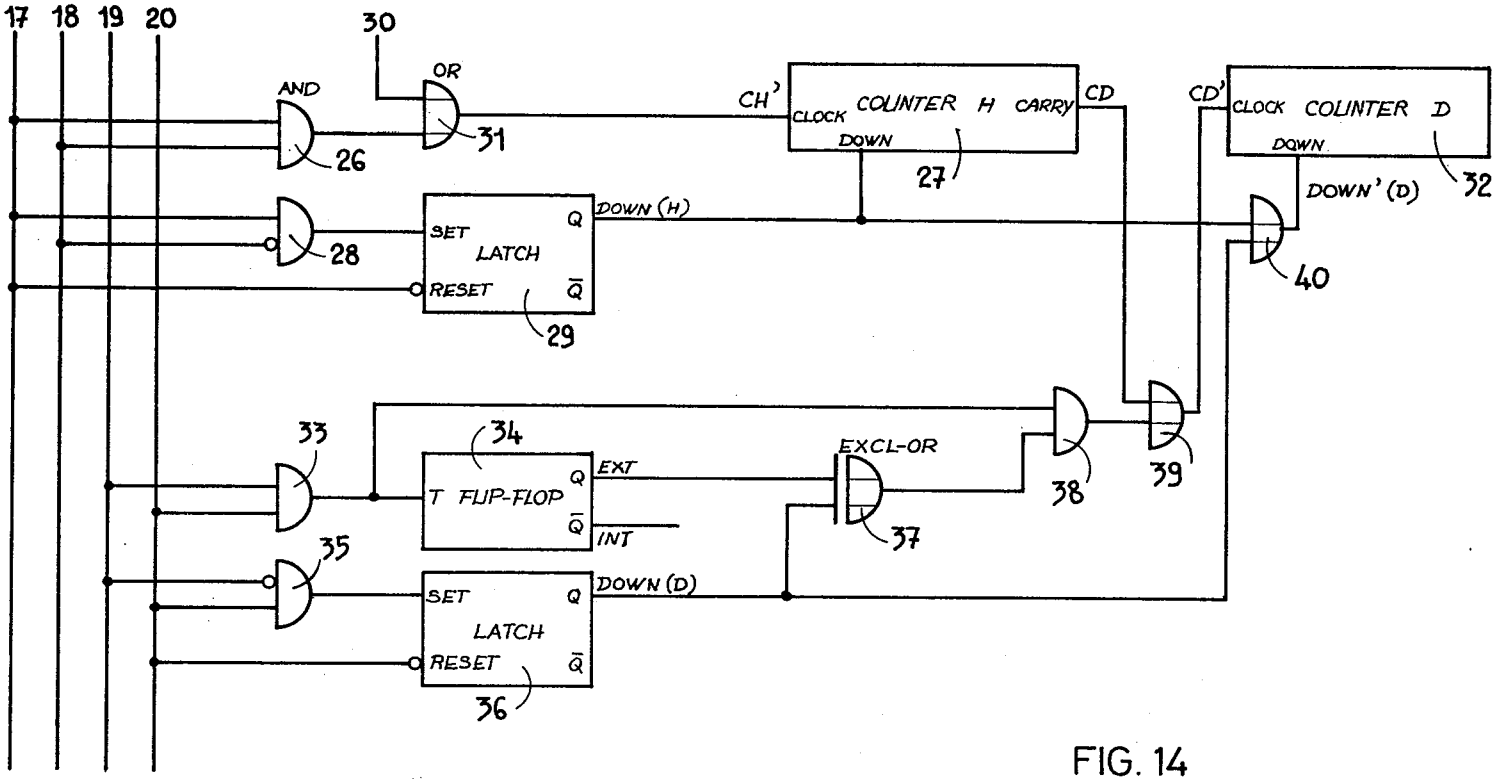
FIG. 14 is a diagram of the electronic circuit of the watch.

The electronic circuit represented in FIG. 14 comprises four lines designated by 17, 18, 19 and 20, which correspond to four outputs 17, 18, 19 and 20, respectively, of FIG. 2.

Signals applied to lines 17 and 18 open an AND door 26, that permits to send a signal on an hours counter 27. A AND door 28 and a LATCH circuit 29 determine if the signal detected on the AND door 26 must be added to or substracted from the hours counter 27.

The control of the hours counter 27 is also effected by means of a signal coming, through a line 30, from the minutes counter, not represented, owing to a OR door 31 which authorizes to pass either the signal coming from the AND door 26 or the signal coming from the minutes counter.

For the control of the dates counter, designated by 32, if signals appear on the lines 19 and 20, a AND door 33 tilts a FLIP-FLOP circuit 34 which controls the indexes 14*a* and 14*b*. A AND door 35 and a LATCH circuit 36 determine in what sense the correction must occur. While comparing the output signals of the FLIP-FLOP circuit 34 and of the LATCH circuit 36 by means of an EXCL-OR (exclusive OR) door 37, it it possible to determine if the correction must be effected or not. Thus, for the passage from London to Iceland, for instance, the EXCL-OR door will not be open, nor a AND door 38, so that the date will not be changed. The sense of the correction is given directly by the LATCH circuit 36.

One sees also that the change of date can be controlled by the hours counter 27, when this one passes from 23 to 0 or from 0 to 23, by the intermediary of a OR door 39, the sense of the correction being determined by the LATCH circuit 29 through a OR door 40.

What we claim is:

1. A universal electronic timepiece which displays the time-belts of the earth, comprising:

a movable indicator of the time-belts;

a bed of electric contacts spaced one from another each having respective control members carried by a movable element moving in synchronism with said movable indicator, said contacts and said control members being spaced one from another such that the contacts are closed by said control members in a first order when said indicator is moved in a first direction and closed in a second order when said indicator is moved in a second opposite direction; and a display device including means for displaying the time in a first time-belt and second means for displaying the time of the time-belt selected by said movable indicator.

2. A timepiece as claimed in claim 1 wherein:

said movable indicator is a rotatable crown which has on one of its faces indicia relating to said time-belts, and which is provided on its opposite face with said control members, said control members including protrusions distributed in groups of two with one group for each time-belt, the two protrusions of each group being situated at different distances from the center of said crown and further being angularly shifted one with respect to the other such that as each group of protrusions passes opposite said bed of contacts two of said contacts will be operated, one by each of said protrusions with the order of operation being determined by the direction in which the said crown is rotated, a first direction subtracting an hour from said time display and a second opposite direction of rotation adding an hour to said time display.

3. A timepiece as claimed in claim 2 wherein:

said crown is divided into twelve divisions, each of said divisions being also divided into two zones, one adjacent the outer periphery of the crown and the second adjacent the inner periphery of the crown, for providing twenty-four zones corresponding to the twenty-four time-belts of the earth with each of said zones in each division corresponding to time-belts situated at the antipodes one from the other;

two electro-optic indexes are associated with said display means, on opposite sides of said crown, with said indexes being alternatively activated to indicate which of said zones the displayed time is indicative of;

one of said groups of protrusions of said crown further including two supplementary protrusions situated at different distances from the center of the crown from one another and from the first two protrusions and angularly shifted one from another and from the other two protrusions of the said one group, said two supplementary protrusions operating two supplementary contacts of said bed of contacts, said two supplementary contacts and protrusions cooperating according to the direction in which said crown is rotated to change the activation of said indexes one to the other in a first direction and to leave said indexes unchanged in the second opposite direction of rotation.

4. A universal electronic timepiece with electro-optic display device comprising:

manually operable means for changing the hour displayed by said display device, said means being operated in a first direction to add one hour to said display and in a second or opposite direction to substract one hour from said display; and means for indicating the time-belts including means for changing the date displayed by said display device, said date being substracted by one from the date being displayed when said means is operated in a first direction and said date being added by one to said date being displayed when said means is operated in a reverse direction as said changing means is moved passed a date change line for said time-belts.

* * * * *